US007578086B2

(12) United States Patent
Swavola, II

(10) Patent No.: US 7,578,086 B2
(45) Date of Patent: Aug. 25, 2009

(54) COLLAPSIBLE DISPLAY FRAME AND METHODS OF USE

(75) Inventor: Michael James Swavola, II, New York, NY (US)

(73) Assignee: QuickFrames, LLC, New York, NY (US)

( * ) Notice: Subject to any disclaimer, the term of this patent is extended or adjusted under 35 U.S.C. 154(b) by 84 days.

(21) Appl. No.: 12/120,266

(22) Filed: May 14, 2008

(65) Prior Publication Data

US 2008/0282594 A1 Nov. 20, 2008

Related U.S. Application Data

(60) Provisional application No. 60/930,681, filed on May 18, 2007.

(51) Int. Cl.
*G09F 17/00* (2006.01)

(52) U.S. Cl. ..... 40/603; 40/610; 40/780

(58) Field of Classification Search ..... 40/603, 40/604, 780, 781, 720, 610
See application file for complete search history.

(56) References Cited

U.S. PATENT DOCUMENTS

| | | | | |
|---|---|---|---|---|
| 399,017 | A * | 3/1889 | Campbell | 40/745 |
| 1,879,251 | A * | 9/1932 | Horbatuck | 40/603 |
| 2,410,987 | A * | 11/1946 | Mevi | 206/268 |
| 2,490,058 | A * | 12/1949 | Jablon | 40/706 |
| 3,673,722 | A | 7/1972 | Robertson | |
| 3,774,332 | A * | 11/1973 | Schneider | 40/720 |
| 3,812,609 | A | 5/1974 | Volden | |
| 4,296,561 | A * | 10/1981 | Lawrence | 40/772 |
| 4,356,647 | A | 11/1982 | Farris | |
| 4,669,209 | A | 6/1987 | Pollack | |
| 4,986,013 | A | 1/1991 | Pollack | |
| 5,343,642 | A | 9/1994 | Magnusson | |
| 5,405,146 | A | 4/1995 | Washington | |
| 6,474,009 | B2 | 11/2002 | Hahn | |
| 6,705,034 | B1 | 3/2004 | Cahill | |
| 6,962,017 | B1 | 11/2005 | Pounds | |
| 7,320,195 | B1 | 1/2008 | Kushner | |

* cited by examiner

*Primary Examiner*—Cassandra Davis
(74) *Attorney, Agent, or Firm*—Michael J. Feigin, Esq.

(57) ABSTRACT

The invention disclosed is a portable and collapsible frame and sheet. In embodiments of the invention, the frame and sheet may be rolled into a tube for easy and safe transport or mailing. In an embodiment of the invention, the frame comprises at least two pairs of elongate members, each elongate member having two ends, each pair of elongate members having at least one pre-attached sheet extending between members of the pair, and each end of each elongate member is adapted for fixed attachment to at least one end of another elongate member, wherein, in an assembled condition, a display is formed with at least partially overlapping sheets.

14 Claims, 13 Drawing Sheets

COLLAPSIBLE DISPLAY FRAME AND METHODS OF USE

This Application Claims Priority to Provisional U.S. Application Ser. No. 60/930,681 filed May 18, 2007.

FIELD OF THE INVENTION

The present invention relates to frames and, more particularly, to collapsible frames.

BACKGROUND OF THE INVENTION

Framing flexible sheet material, such as a piece of artwork, has long been known. However, flexible sheet material frames which are collapsible and allow for easy storage and transport are much less common in the art. Such devices typically provide limited protection to a sheet and limited ability to construct and deconstruct, or cause damage to the sheet itself. This damage means that the sheet cannot be used a second time in a different frame and/or that the sheet will lose value.

For example, U.S. Pat. No. 4,356,647 to Farris and U.S. Pat. No. 6,474,009 to Hahn teach apparatuses for holding or displaying a sheet-like item such as a poster. First and second generally identical members extend longitudinally on opposite sides of the poster. However, other than the top and bottom side of the sheet-like item, the item is not protected. For example, sheer forces extending diagonally or transverse to the top and bottom members will cause the sheet to rip. The weight of the bottom member may make the sheet more likely to tear as it exerts a constant weight on the sheet when, for example, the device is hung on a wall for display. Front and back protection of the sheet has also not been disclosed, and the items cannot be adapted for embodiments other than hanging in a top-bottom or bottom-top orientation.

Other collapsible picture frames known in the art may be expensive to manufacture and procure and contain many pieces which may easily be lost. For example, U.S. Pat. Nos. 4,669,209 and 4,987,013, both to Pollack, provide protection on at least four sides of a sheet such as a picture, but require at least eight pieces to produce the frame, including four sides and four corners, and require a plethora of steps to configure. Further, such frames are difficult to package or ship with a sheet itself, which necessitates packaging in separate packages or using extra material to prevent damage of a sheet by a piece of the frame.

Still other frames, such as disclosed in U.S. Pat. No. 6,962,017 to Pounds, not only require a plethora of pieces and carry the disadvantages of the above-described references, but all damage the sheet-like item by requiring holes to be pierced in the item. This is often not acceptable, such as with an expensive piece of art work, or when electronics are involved and a hole will reduce their functionality.

Thus, there has been a long-felt and unsolved need to provide a framing device which is simple to manufacture, easy to procure, has a small number of pieces, can be safely shipped with a sheet such as a piece of art, and is adaptable to provide protection to the sheet on at least four sides, but, preferably, also on the front and back.

SUMMARY OF THE INVENTION

It is therefore an object of the invention to provide a device for framing a sheet-like material such as a sheet. It is a further object of the invention to provide frames which may be pre-assembled with the sheet-like material, such as for shipping in tubes, without the need for further packaging or protective material.

It is a further object of the invention to provide a frame which may be collapsed or configured to display a sheet with minimal effort and in a protected manner.

It is yet another object of the invention to provide a collapsible frame and sheet, the sheet protected by a backing and/or a front panel.

It is yet another object of the invention to provide a collapsible frame with component members which may be rearranged in a variety of configurations.

The invention disclosed comprises a frame comprising at least two pairs of elongate members, each elongate member having two ends, each pair of elongate members having at least one pre-attached sheet extending between the pair, and each end of each said elongate member being adapted for fixed attachment with at least one end of another elongate member, wherein, in an assembled condition, a display is formed with at least partially overlapping sheets.

The at least two pairs of elongate members may be a first pair of elongate members connected at a right angle to a second pair of elongate members, and each sheet substantially covers an area defined by the first and second pair of elongate members. At least one sheet may be flexible and/or at least one sheet may be rigid.

In an embodiment of the invention, a sheet of a first pair of elongate members substantially overlaps sheets of both a second pair and a third pair of elongate members.

The sheet (or "sheet-like material" as used in the disclosure) may be a backing, an artistic work, a cover, an electronic display, solar panel, organic sheet, or a combination thereof. Each pair of elongate members may be preconfigured and pre-attached to a corresponding sheet and placed in a tube, such as for shipping. The at least one pair of elongate members may comprise a plurality of sheets.

The first pair of elongate members has situated there between a rigid backing sheet and a rigid cover sheet, and a second pair of elongate members has situated there between a flexible sheet as defined above such as an artistic work.

An attachment of an end of a first elongate member and an end of a second elongate member may comprise a magnet, a dowel and pin, a mortise and tenon, a magnetic tape, or a combination thereof.

In an embodiment of the invention, the frame comprises at least two overlapping sheets, the sheets offset (a) at least 90 degrees from each other, or (b) at least 15 degrees from each other, and each sheet is attached at a first end to a first elongated frame member and a second end to a second elongated frame member. Each elongated frame member has two ends, and each end of each elongate frame member is rigidly attached to an end of another elongate frame member. At a 90 degree offset, two or more pairs of elongated frame members may be used. At a 30 degree offset, three or more pairs of elongated frame members may be used. Other offsets may be at 15 degrees (12 sheets when each elongate member is substantially similar in length), 45 degrees (4 sheets when each elongate member is substantially similar in length), and 60 degrees (when each elongate member is substantially similar in length). In embodiments of the invention, the frame members are straight. However, in other embodiments of the invention, such as when the angle of one module with respect to another is less than 90 degrees, the individual frame members may be curved or angled.

A sheet may be pre-attached to the first and second elongated frame member, or a sheet may be frictionally or adhesively held between two said elongated frame members in an assembled condition of the frame. At least one said sheet may be flexible or rigid. The at least two sheets may be three sheets.

The frame members may be attached by a magnet, dowel and pin, mortise and tenon, magnetic tape, adhesive, zipper, Velcro, or a combination thereof. Substantially any attachment device known in the art may be used. The sheet may be an organic or electronic display and the display may be flexible.

A method of configuring the display of the invention is also taught. At least a first and second module of a display, each module comprising two frame members and a sheet situated there between, may be configured in a display by positioning a first module at a location and positioning a second module on (meaning, on, over, in front of, or on top of) said first module, offset at least 30 degrees from said first module. Then, the display is configured by attaching at least one frame member of the first module to the at least one frame member of the second module. The offset may be 90 degrees. The location may be a table, an easel, or a wall. An object, such as a biological/organic, electronic, or artistic work may be placed between two sheets or modules.

DETAILED DESCRIPTION OF THE EMBODIMENTS

The invention disclosed is a portable and collapsible frame and sheet. In embodiments of the invention, the frame and sheet may be rolled into a tube for easy and safe storage, transport or mailing. In an embodiment of the invention, the frame comprises at least two pairs of elongate members, each elongate member having two ends, each pair of elongate members having at least one pre-attached sheet extending between members of the pair, and each end of each elongate member is adapted for fixed attachment to at least one end of another elongate member, wherein, in an assembled condition, a display is formed with at least partially overlapping sheets.

The embodiments of the invention will become clearer in reference to the following figures.

Figure 1:
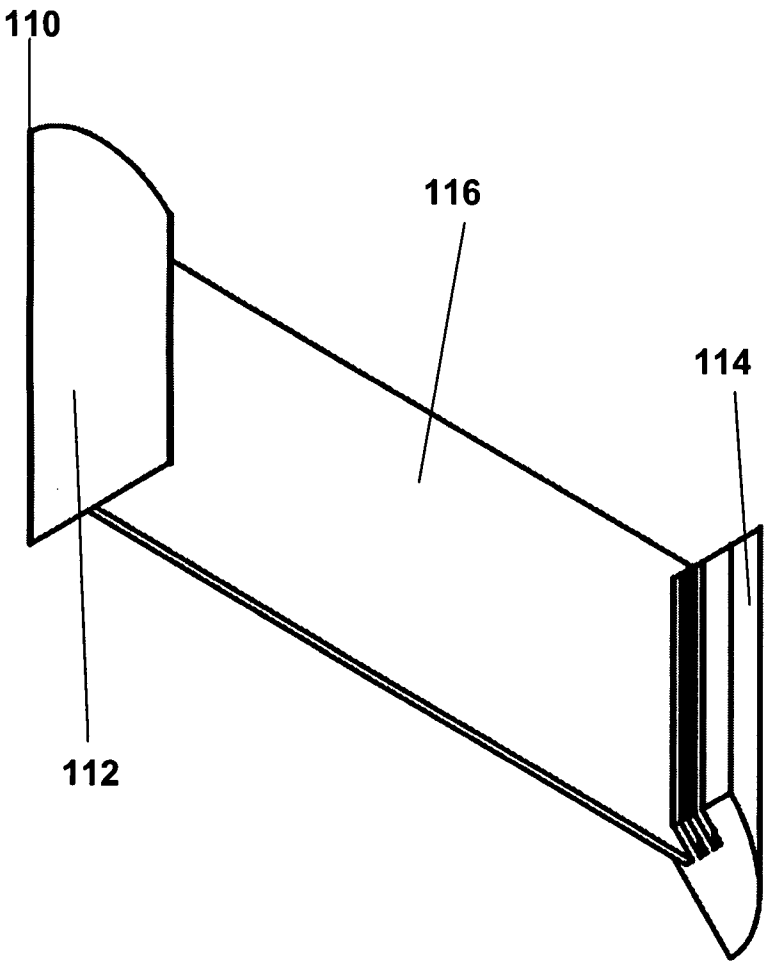
FIG. 1 shows a first module of a collapsible display frame and picture as used in an embodiment of the invention.

FIG. 1 shows a first module of a collapsible display frame and picture as used in an embodiment of the invention. The module 110 is comprised of two elongate frame members. The left member 112 and right member 114 are connected with, or frictionally engaged with, a sheet 116. The right and left members 114 and 112 may be fixedly attached to the sheet 116 or may be pre-attached, forming a unitary structure. The sheet 116 is rigid in a first embodiment of the module and flexible in a second embodiment of the module.

Figure 2:
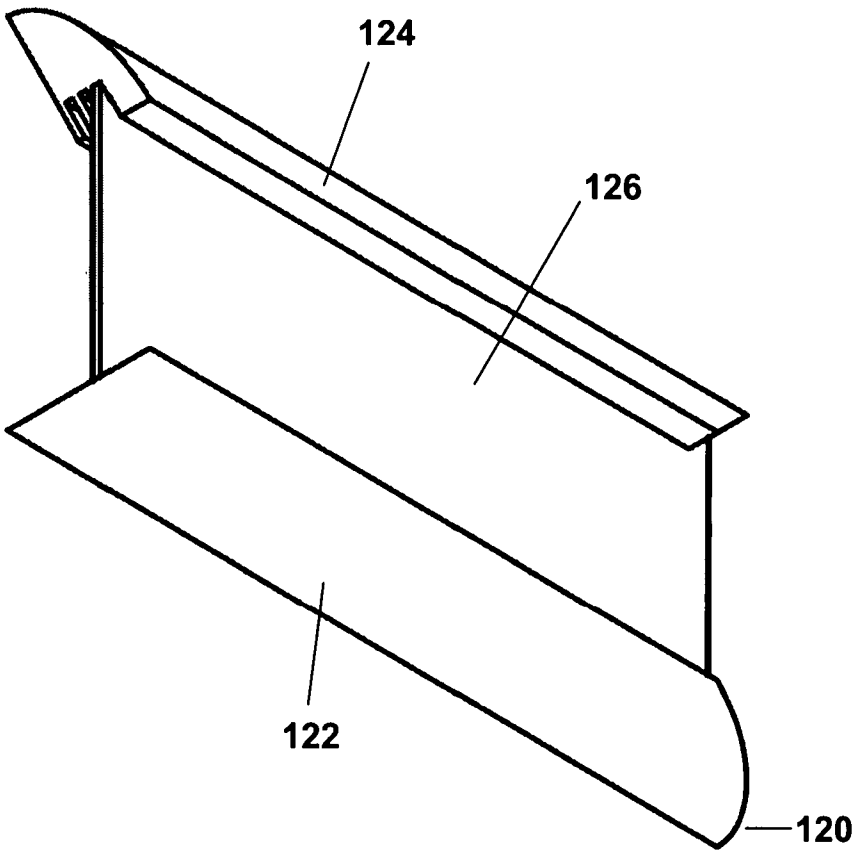
FIG. 2 shows a second module of a collapsible display frame and picture as used in an embodiment of the invention.

FIG. 2 shows a second module of a collapsible display frame and picture as used in an embodiment of the invention. The module 120 is comprised of a top member 124 and bottom member 122, which are connected with, or frictionally engaged with, a sheet 126. The top and bottom members 124 and 122 may be fixedly attached to the sheet 126 or may be pre-attached, forming a unitary structure. The sheet 126 is rigid in a first embodiment of the module and flexible in a second embodiment of the module.

Sheet 116, sheet 126 and further sheets, as noted above, may be rigid or flexible. In an embodiment of the invention, a third or more sheets may be used. Each sheet may be rigid or flexible, depending upon the embodiment of the invention. For example, when displaying a picture, a sheet 116 may be a rigid opaque backing and a sheet 126 may be a rigid Lucite protective cover of a picture placed between sheets 116 and 126. In another example, both the backing sheet 116 and cover sheet 126 may be flexible. In yet another example, sheet 116 is a backing and sheet 126 is a picture or piece of artwork. In embodiments of the invention where flexible sheets are used, such sheets with their respective top and bottom (or right and left) members may be rolled.

Sheets, as used in the invention, may be rigid or flexible, elongated and generally flat items. Sheets of the invention generally have functional, artistic, protective or structural characteristics, or combinations of these features. Artistic sheets may comprise a piece of art, a photo, an LCD display, an OLED display, another form of electronic display, and so forth. An artistic sheet may be flexible and/or rollable or rigid. Protective sheets may be Lucite protective covers, plastic covers, glass covers, cardboard backings, wood backings, and so forth. A protective sheet may be flexible and/or rollable or rigid. Structural sheets are generally rigid and ensure, in addition to the structure of the frame itself, the structural integrity and protection of the frame and other sheets. Sheets may be formed as unitary structures with top and bottom members 124 and 122 or left and right members 112 and 114. A sheet may also be a mirror or have reflective characteristics. It is contemplated as part of the scope of the invention to combine usage of any of the above-described sheets in embodiments of the invention. Examples of such combinations include one transparent sheet and one piece of artwork; one transparent sheet, one piece of artwork and one backing; two transparent sheets and one piece of artwork; two backing sheets and one piece of artwork; or any combination thereof.

In embodiments of the invention, further sheets or objects are inserted into a frame between two sheets. An object, may, for example be a biological object (such as a growing bacteria), household object for display (such as a baseball), or another sheet (such as a poster or paper frictionally held between two sheets). In an embodiment of the invention, two artistic works (including posters) or a double-sided artistic work may be inserted between two sheets, such as the two sheets attaching to frame members, i.e. the artistic work or works are placed between two modules. In such an embodiment, a frame in a configured condition may be reversible whereby on one side, a first artistic work is displayed and on the other side, a second artistic work is displayed. The artistic work or works in this embodiment of the invention may also be an object or objects.

Figure 3:
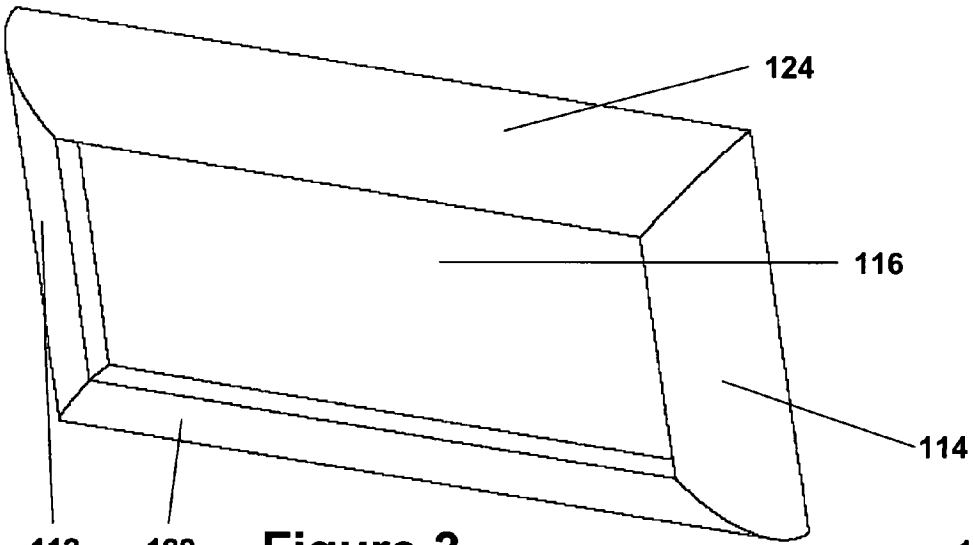
FIG. 3 shows a top perspective view of a collapsible display frame of the invention in a configured state.
Figure 4:
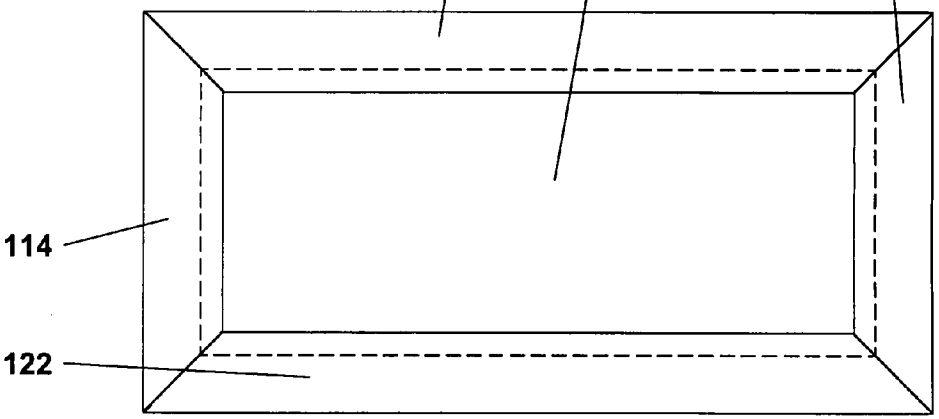
FIG. 4 shows a back plan view of a collapsible display frame of the invention in a configured state.

FIG. 3 shows a top perspective view of a collapsible display frame of the invention in a configured state. FIG. 4 shows a back plan view of a collapsible display frame of the invention in a configured state. The corners of the elongated top, bottom, right, and left members are joined together by attachment means or by frictional means by way of methods known in the art and will be explained in the forthcoming paragraphs. The dotted lines on FIG. 4 represent the position of the sheet 126 in this embodiment of the invention. Sheet 116 is displayed at the front of the device and, when translucent or transparent, allows a user to see the generally large rectangular unblocked portion of sheet 126 (i.e., not covered by an elongated top, bottom, right, or left member.

Figure 5:
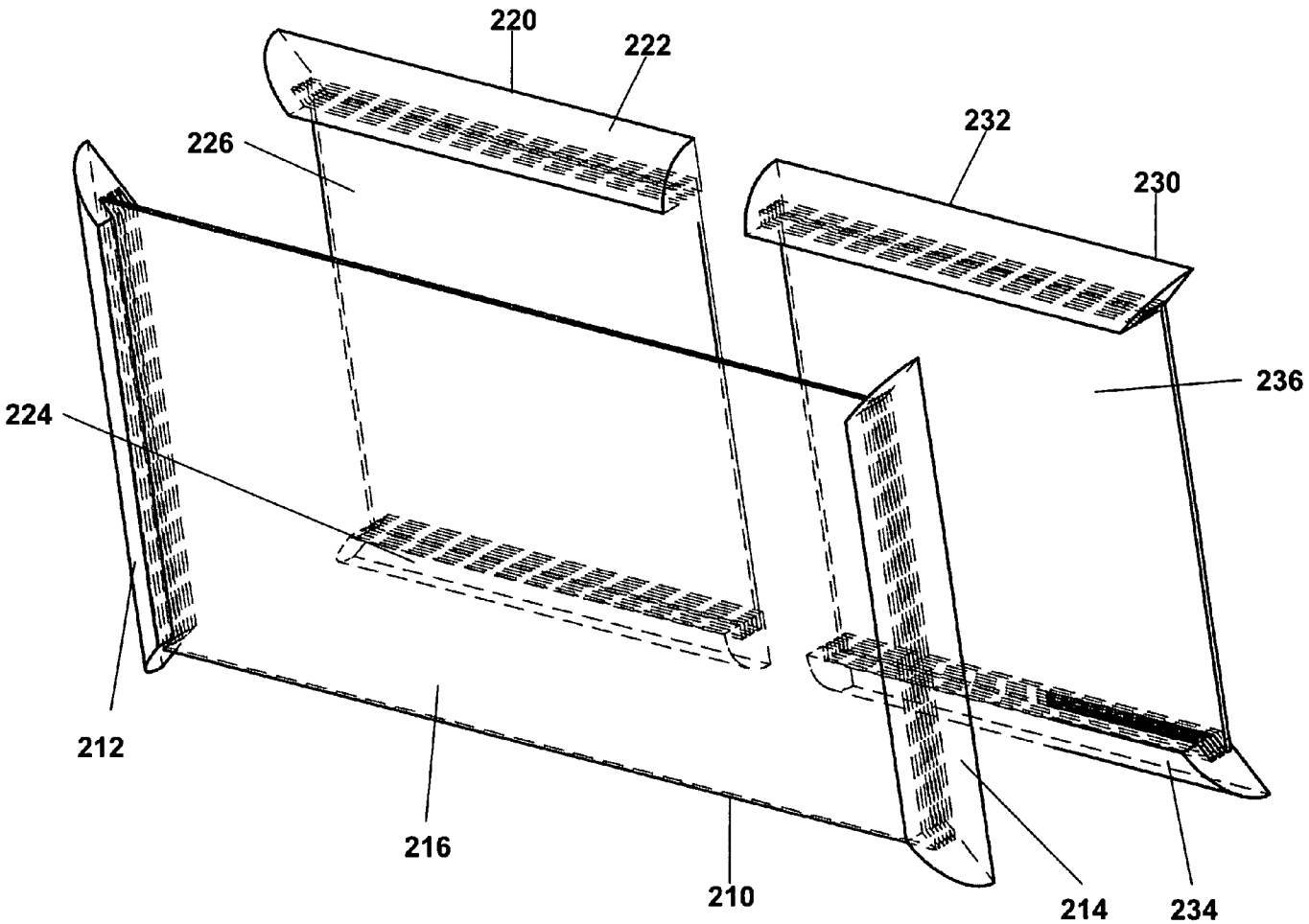
FIG. 5 shows a front perspective view of an embodiment of the invention with a split frame in a semi-collapsed state.

FIG. 5 shows a front perspective view of an embodiment of the invention with a split frame in a semi-collapsed state. The embodiment of this figure is an illustration of one of many possible configurations of the invention. In this embodiment, a first unit 210 comprises a sheet 216 connected to a left member 212 and right member 214 in a similar manner as the embodiments of FIGS. 1-4. A second unit 220 comprises a sheet 226 attached to a top member 222 and bottom member 224. A third unit 230 comprises a top member 232 and bottom member 234, attached to a sheet 236. The adjacent corners of the elongated frame members 222, 224, 232, and 234 of unit 220 and 230 attach to each other or are frictionally engaged with each other. That is, the adjacent corners of top member 222 and top member 232 attach, as well as bottom members 224 and 234. Similarly, the adjacent corners of unit 210 attach or frictionally engage with units 220 and 230. That is, adjacent corners of members 222 and 224 attach to the respective corners of member 212, and members 232 and 234 attach to respective corners of member 214.

Figure 6:
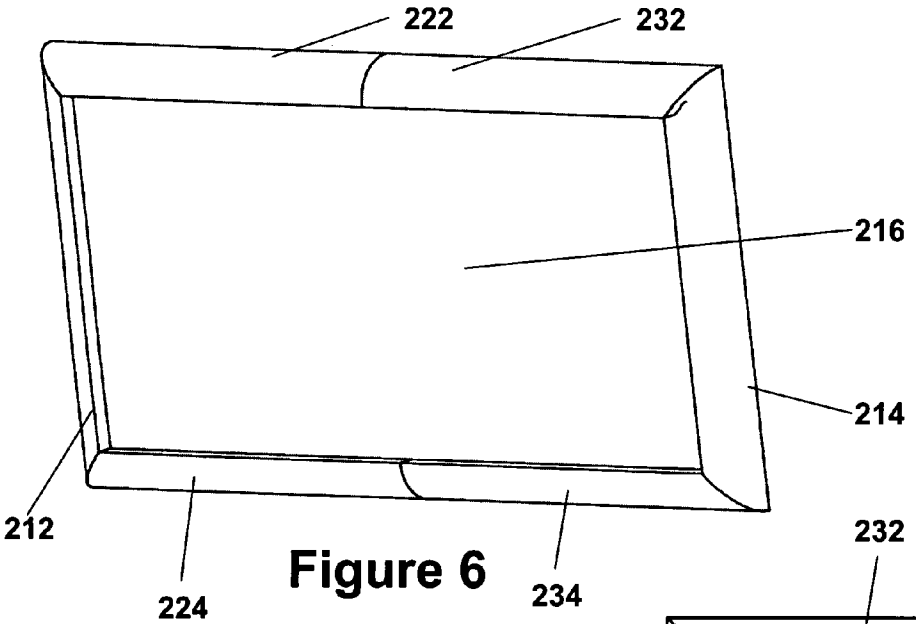
FIG. 6 shows a front perspective view of an embodiment of the invention with a split frame in a configured state.
Figure 7:
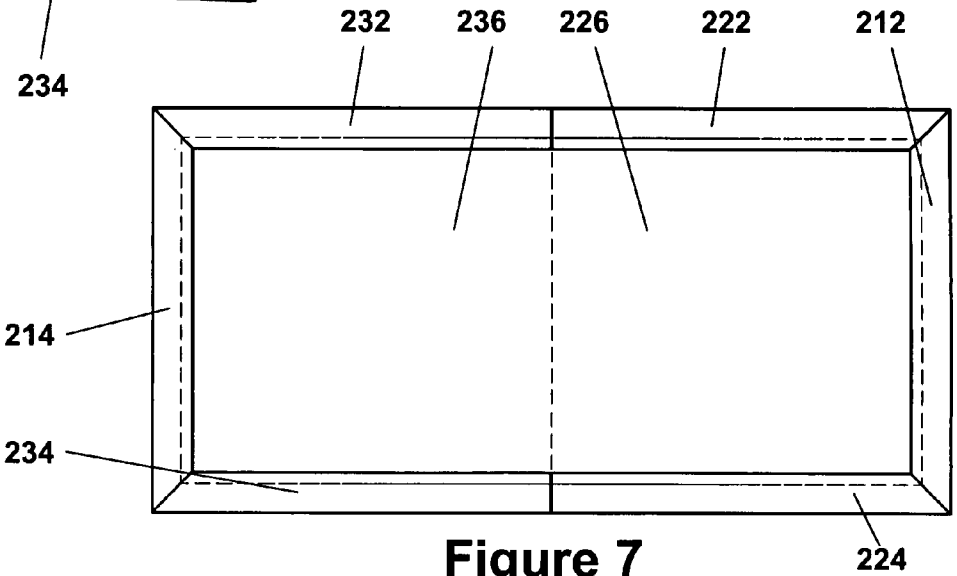
FIG. 7 shows a rear plan view of an embodiment of the invention with a split frame in a configured state.

FIG. 6 shows a front perspective view of an embodiment of the invention with a split frame in a configured state. FIG. 7 shows a rear plan view of an embodiment of the invention with a split frame in a configured state. In the configured state of the present embodiment of the invention, a top portion of the frame is comprised of top members 222 and 232, a bottom portion of the frame is comprised of bottom members 224 and 234, a left portion of the frame is comprised of member 212 and a right member of the frame is comprised of member 214. A sheet 216 is exhibited on the front side of the configured frame and may be translucent or transparent, so that sheets 236 and/or 226 are visible. The present embodiment is illustrative of one of many embodiments of the invention which are within the scope of the invention. Any combination of members with attached sheets may be used or preconfigured so as to allow for a modular frame to be constructed and deconstructed rapidly, while providing protection to a sheet on the edges and optionally on the front and/or back sides of the sheet during both the collapsed or configured states of the device.

Figure 10:
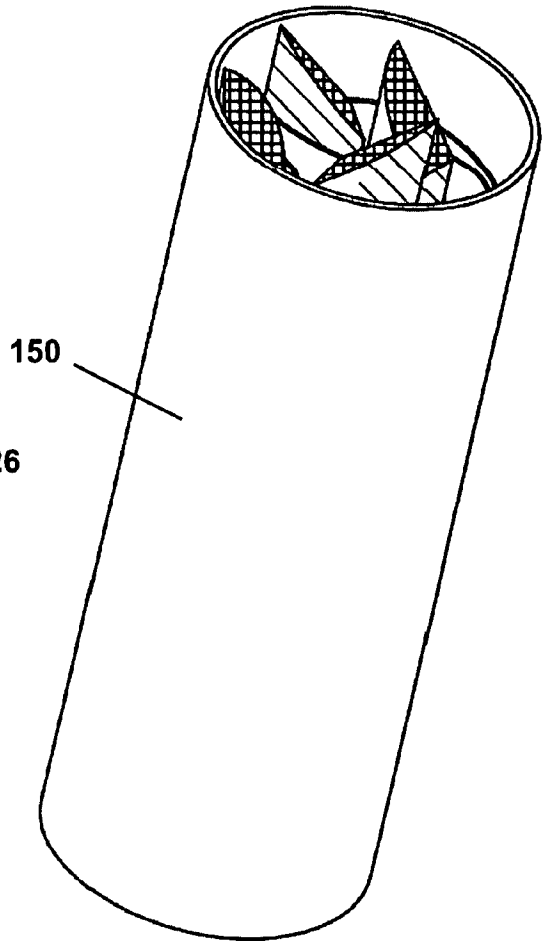
FIG. 10 shows a tube holding the first and second modules of the collapsible display frame of embodiments of the invention in a rolled configuration.
Figure 9:
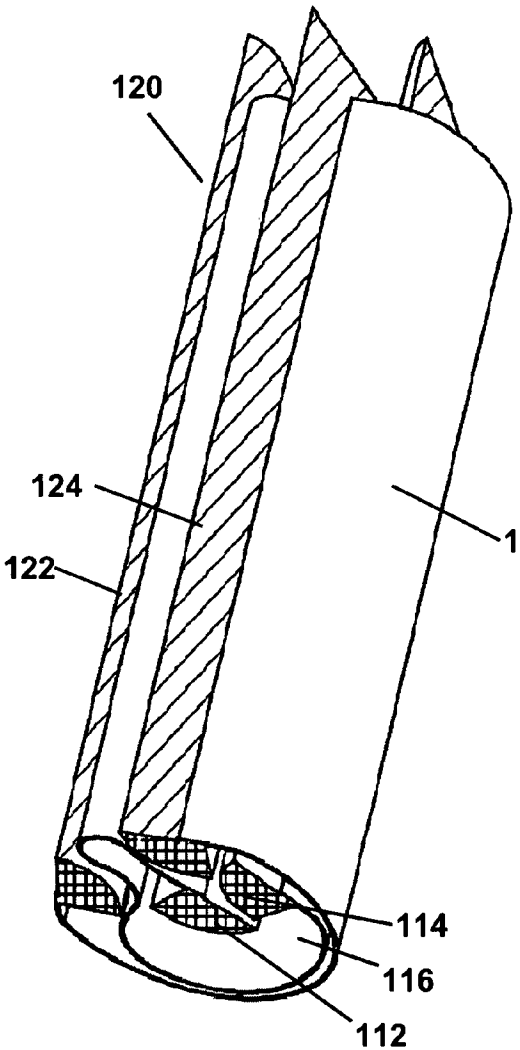
FIG. 9 shows a first and second module of the collapsible display frame of embodiments of the invention in a rolled configuration.
Figure 8:
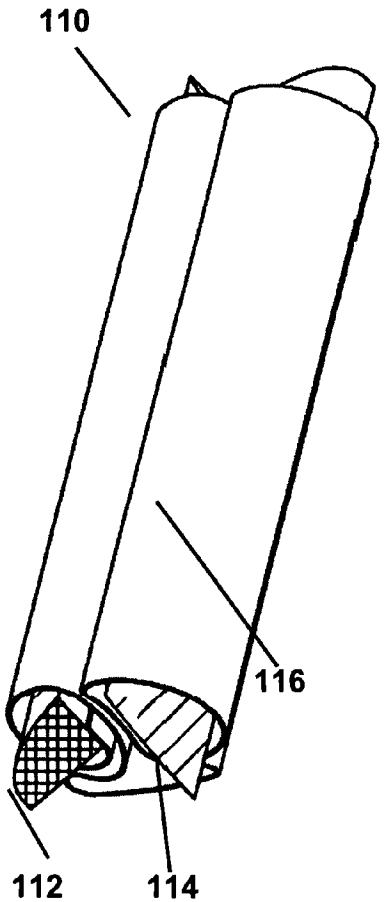
FIG. 8 shows a first module of the collapsible display frame of embodiments of the invention in a rolled configuration.

FIGS. 8-10 show a rolled configuration of a collapsible display frame in embodiments of the invention. Sheets 116, 126 and other sheets used in such embodiments are typically flexible sheets which may be rolled and unrolled.

FIG. 8 shows a first module of the collapsible display frame of embodiments of the invention in a rolled configuration. The rolled configuration is a fully collapsed state of a module because the module 110 is not connected to another frame module and a sheet is not being exhibited. While the module 110 may be rolled substantially in any manner, in the embodiment depicted, first member 112 and second member 114 act as rollers around which sheet 116 is wrapped.

FIG. 9 shows a first and second module of the collapsible display frame of embodiments of the invention in a rolled configuration. In this embodiment of the invention, the second module 120 is wrapped around the first module 110. Typically, the larger module is wrapped around the smaller module to assure usage of the minimum amount of volume. Thus, for example, the module 110 of FIG. 8 is wrapped in the module 120 of FIG. 9.

FIG. 10 shows a tube holding the first and second modules of the collapsible display frame of embodiments of the invention in a rolled configuration. Such a tube 150 may be a mailer tube, as is commonly used when a parcel is sent via a mail carrier or delivery service to a recipient. In this manner, modules 110 and 120, for example, may be rolled and placed into a tube for mailing or for each protected transport thereof. Thus, when rollable sheets are used, the device of the invention may be easily and economically protected and transported from place to place and assembled as necessary. In an embodiment of the invention, a sheet is an LCD or other form of electronic or organic sheet which may include functions such as a touch screen or be part of a personal digital assistant. An organic sheet, may for example, be configured for usage with growing biological or laboratory materials. When desired by a user, the modules, which are protected in the tube 150, may be removed and easily assembled into the fully configured state of the invention, wherein the electronic display (or other sheet) is protected by the frame members and, in embodiments of the invention, a backing and/or a front sheet.

Figure 11:
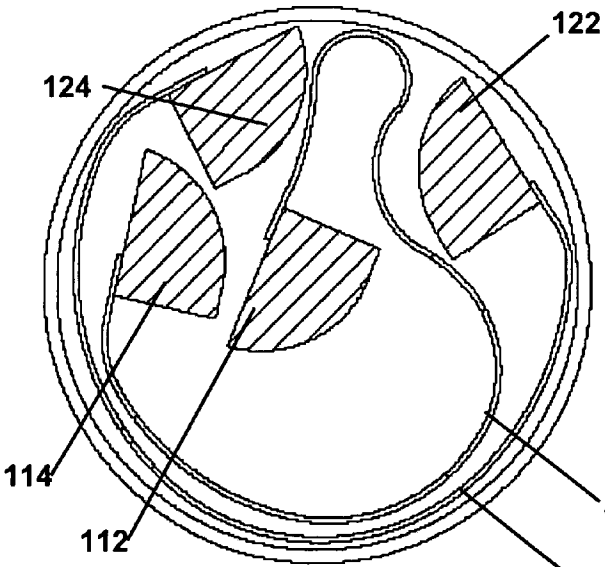
FIG. 11 is a top plan view of the frame of FIG. 10.
Figure 12:
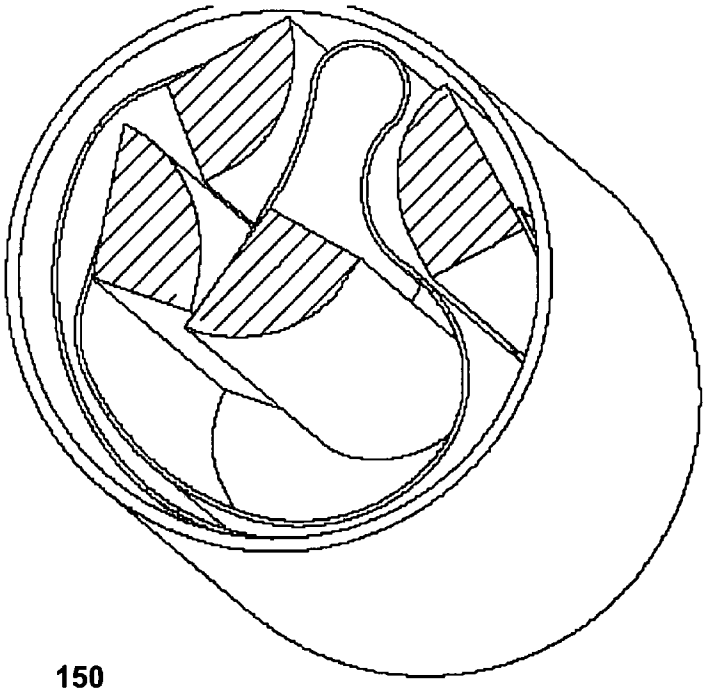
FIG. 12 is a top perspective view of the frame of FIG. 10.
Figure 13:
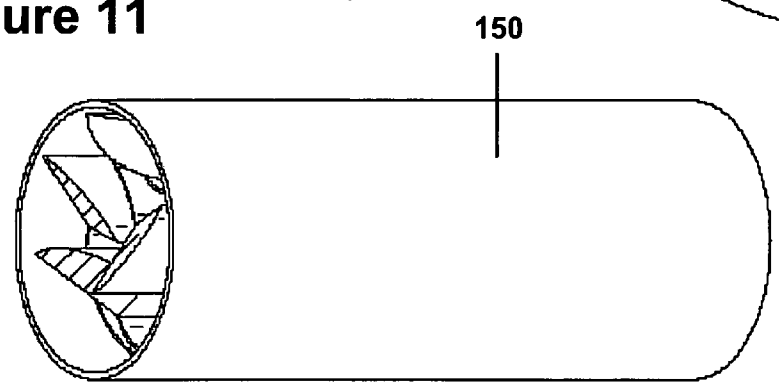
FIG. 13 is a side perspective view of the frame of FIG. 10.

FIGS. 11-13 show various views of the modules in a rolled configuration of the invention. FIG. 11 is a top plan view of the frame of FIG. 10. FIG. 12 is a top perspective view of the frame of FIG. 10. FIG. 13 is a side perspective view of the frame of FIG. 10.

Figures 14A, 14B, 14C:
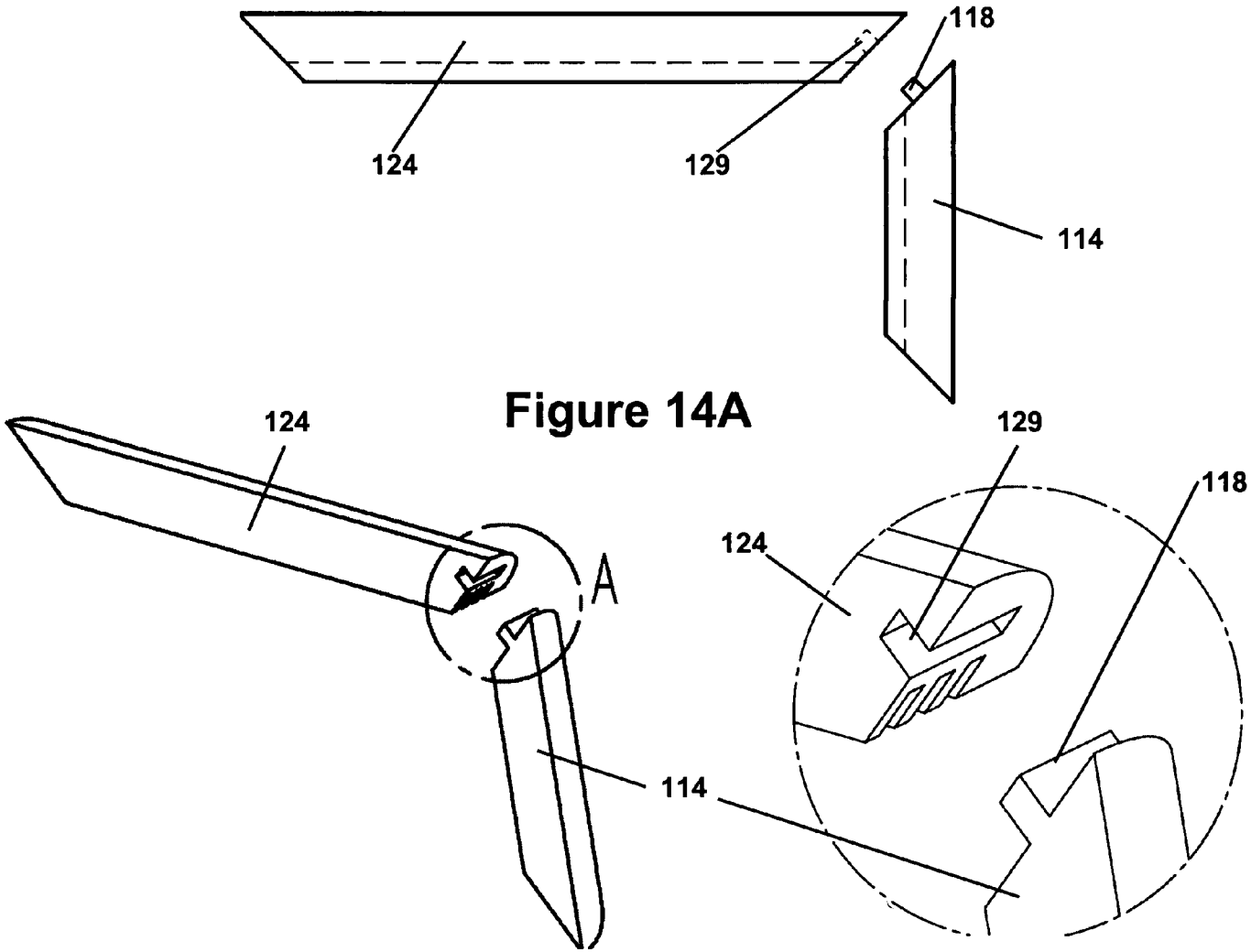
FIG. 14A shows a side plan view of a mortise and tenon used to attach two frame members in an embodiment of the invention.
FIG. 14B shows a perspective view of the mortise and tenon joint of FIG. 14A.
FIG. 14C shows detail A of FIG. 14B.

FIG. 14A shows a side plan view of a mortise and tenon used to attach two frame members in an embodiment of the invention. FIG. 14B shows a perspective view of the mortise and tenon joint of FIG. 14A. The figure shown is by example only. Typically, each frame member is attachable or pre-attached to a sheet and second frame member. Any mortise and tenon system known in the art may be used, such as a wedged, stub, haunched stub, foxtail, pinned, or feather joint. As will be understood by a person having ordinary skill in the art, some of these joints are substantially permanent (that is, to detach the joint, once formed, requires significantly greater force than attaching it and/or will destroy the frame or mortise and tenon system). Other joints are substantially reversible (that is, detachment requires approximately the same amount of force as attachment and/or the joint may be disassembled and reassembled a plurality of times without causing noticeable damage to the frame or joint). In the embodiment of FIG. 14A, a single mortise and tenon is depicted, but such a joint, when used, is typically used on all joints of the frame members. Such joints are typically located at the corners of all frame members (the ends of the longitudinal piece which comprises each frame member).

Referring now to FIGS. 14-16 in general, and FIG. 14C specifically, FIG. 14C shows detail A of FIG. 14B. Top frame member 124 and side frame member 114, by way of example, comprise a mortise 129 and tenon 118, respectively. Any combination of mortise and tenon may be used in embodiments of the invention. For example, the mortise may be on the first member and tenon on the second member, or vice versa. Similarly, a plurality of mortises and tenons may be used in a joint. Tenon 118 is configured to snugly fit within mortise 129 such that, in a configured state of the device of the invention, the top member 124 and side member 114 are frictionally held in place or attached. It should also be understood that the slots depicted in FIG. 14C are used in an embodiment of the invention for holding sheets slid into them. However, other embodiments of the invention may use various mechanisms for attachment or frictional engagement with one or more sheets.

Figure 15B:
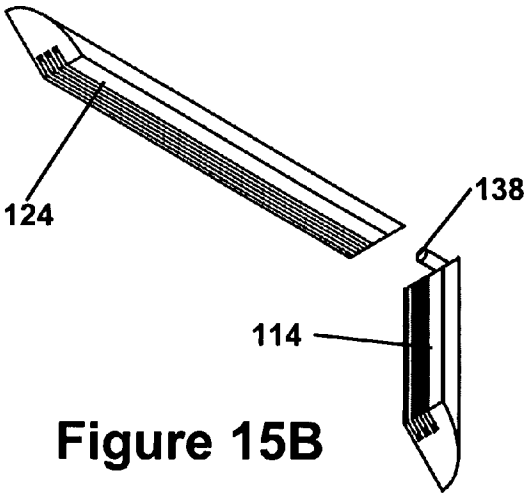
FIG. 15B shows a perspective view of the embodiment of FIG. 15A.
Figure 15D:
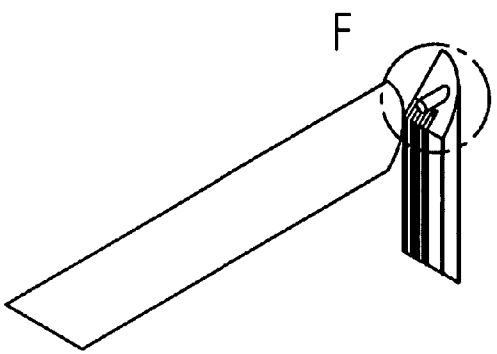
FIG. 15A shows a side plan view of a pin used to attach two frame members in an embodiment of the invention.
FIG. 15C shows insert F of FIG. 15D.
Figure 15A:
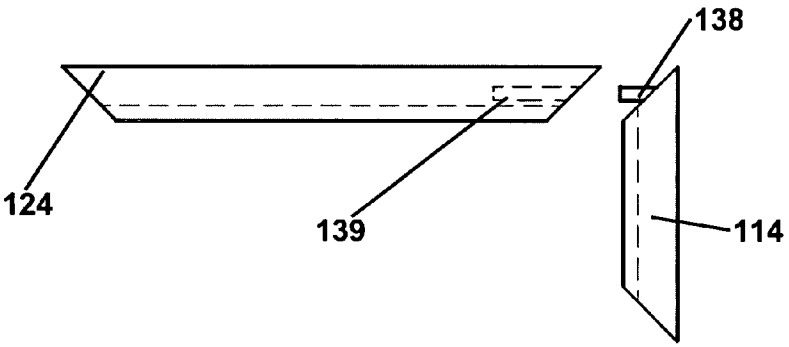

FIG. 15A shows a side plan view of a pin used to attach two frame members in an embodiment of the invention. This embodiment of the invention is similar to the mortise and tenon embodiment in that a pin 138 of a member, such as side member 114, enters into and attaches or frictionally engages with a cavity 139 of a second member, such as top member 124. Glue may be used to make the engagement irreversible.

Figure 15C:
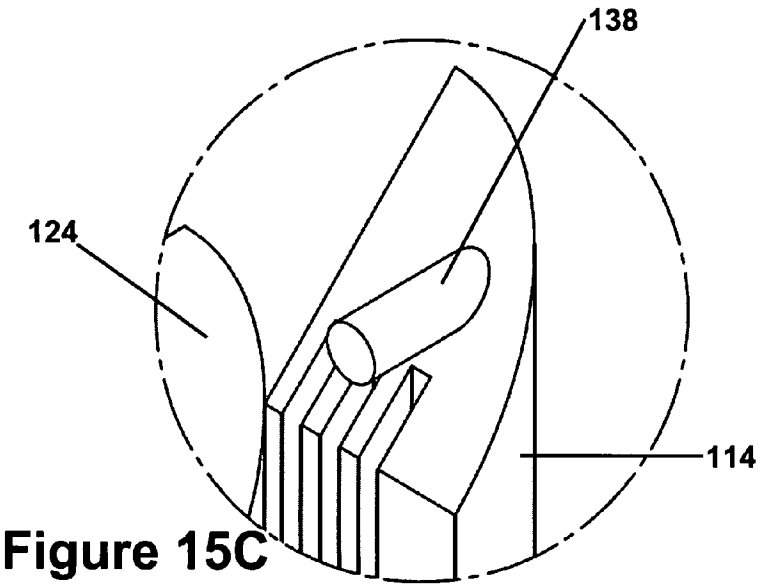

FIG. 15B shows a perspective view of the embodiment of FIG. 15A. FIG. 15C shows insert F of FIG. 15D. FIG. 15D shows another perspective view of FIG. 15A. Referring now to FIG. 15C in particular, pin 138 extends out from the corner of side member 114. The corner, at least in this embodiment, is defined as the tapered or angled region as shown in FIG. 15C. The corner is adapted for abutment with a respective corner of a second member, which, in this instance, is the corner of the top member 124 (as shown in FIG. 15A). The pin 138 extends into the cavity 139 (shown in FIG. 15A) to attach the respective members 124 and 114. In this manner, each member may be attached to an adjacent member. The pin 138 and cavity 139 (as well as the mortise and tenon in the previous embodiment) may be used in conjunction with each other, i.e., together in one connection or to attach separate pairings of corners. Further, a pin, cavity, mortise, or tenon may be angled at a degree other than 90 degrees, such as between 15 and 165 degrees. Each corner in such angled embodiments is tapered accordingly and allows for the various angles of attachment.

Figure 16B:
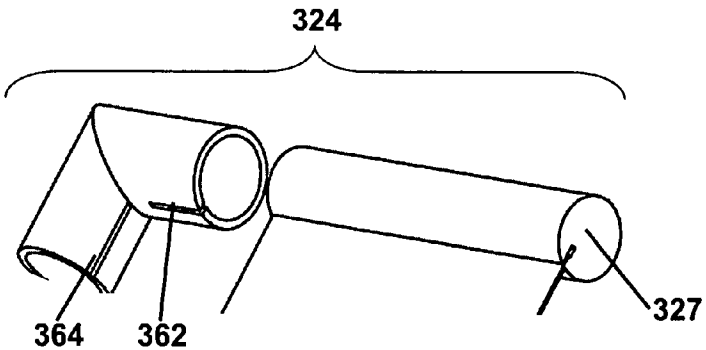
FIG. 16B shows an exploded view of a frame member as used in the round socket joint embodiment of the invention.
Figure 16A:
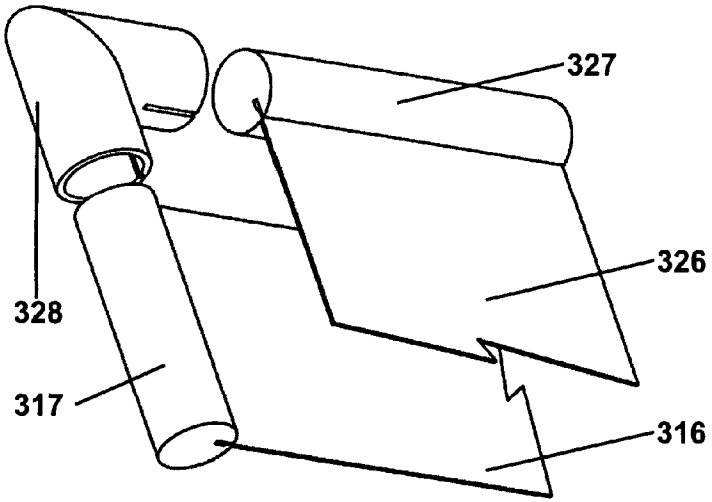
FIG. 16A shows an exploded view of a part of an embodiment of the invention comprising round socket joints.

FIG. 16A shows an exploded view of a part of an embodiment of the invention comprising round socket joints. FIG. 16B shows an exploded view of a frame member as used in the round socket joint embodiment of the invention. A top member 324 comprises a corner 328 and longitudinal member 327. In one embodiment of the invention, each corner is detachable from each of at least two longitudinal members (i.e., longitudinal member 327 and 317). In another embodiment of the invention, each corner, such as corner 328, is fixedly attached to, or forms a unitary structure with, a longitudinal member, such as longitudinal member 327. In this manner, the method of configuring the frame in this embodiment of the invention is similar to, or the same as, that of the embodiments depicted in FIGS. 1-15, i.e., all modules comprising two frame members and a sheet situated there-between are disposed 90 degrees with respect to one another and attached at the corners thereof. The sheets 316 and 326 may be pre-attached to (forming a unitary structure with) the respective frame members or may be attachable by a user.

Referring again to FIGS. 16A and 16B, slots, such as slots 362 and 364, are cut into and extend through a side of the generally hollow corner members, such as corner member 328, in such a manner as to allow each corner to connect to at least two longitudinal members and allow at least one sheet member to extend through each slot. A plurality of slots may be used as necessary when a plurality of sheets is planned for use with the collapsible frame of the invention.

Figure 17B:
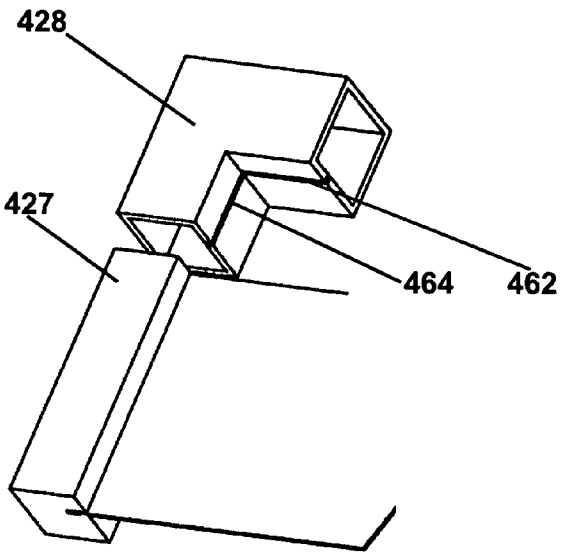
FIG. 17B shows an exploded view of a frame member as used in the square socket joint embodiment of the invention.
Figure 17A:
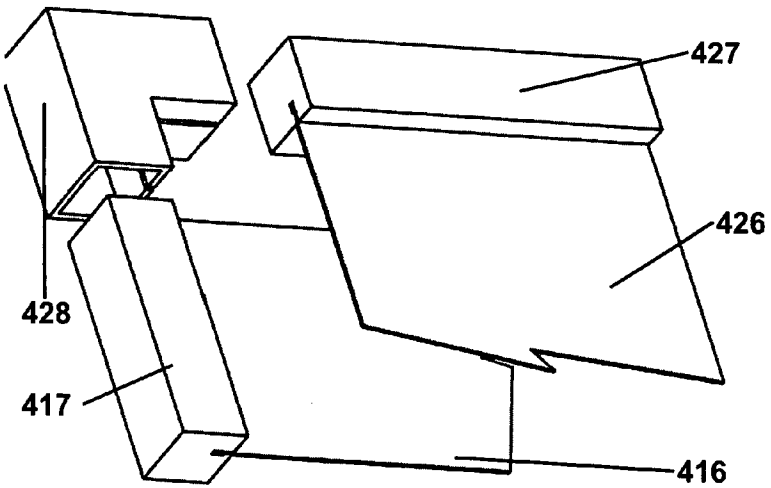
FIG. 17A shows an exploded view of a part of an embodiment of the invention comprising square socket joints.

FIG. 17A shows an exploded view of a part of an embodiment of the invention comprising square socket joints. FIG. 17B shows an exploded view of a frame member as used in the square socket joint embodiment of the invention. The embodiment of FIGS. 17A and 17B is analogous to the embodiment of FIGS. 16A and 16B, and the numbered elements have been incremented by 100. It should be noted that the corner members 428 may be fixedly attached to, or form a unitary structure with, any of the top, bottom, right, or left frame members.

Figures 18A, 18B, 18C, 18D:
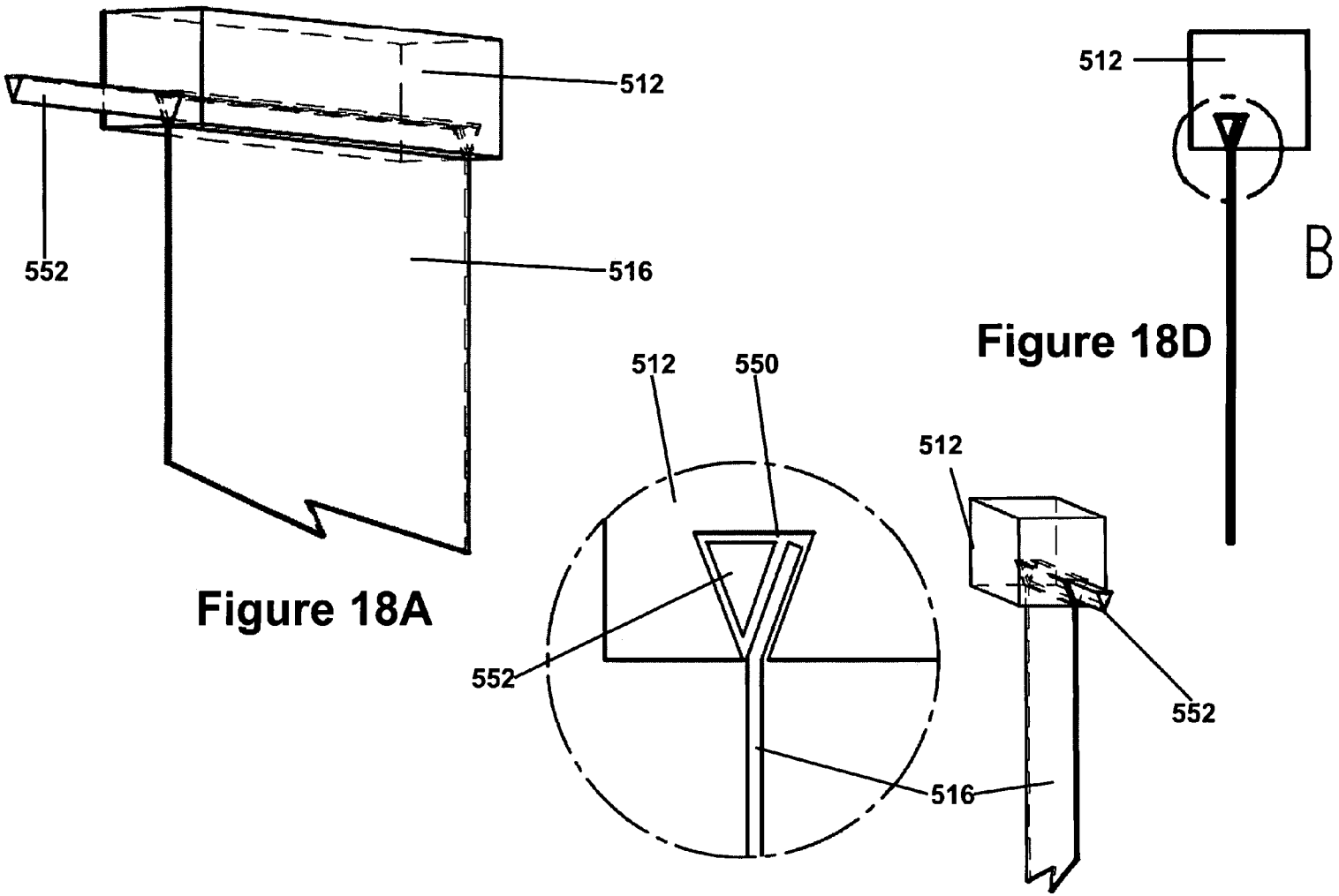
FIG. 18A is a side perspective diagrammatic view of an attachment mechanism for attaching a sheet to a frame member in an embodiment of the invention.
FIG. 18B is inset B of FIG. 18D.
FIG. 18C is a second side perspective view of the attachment mechanism of FIG. 18A.
FIG. 18D is a side plan view of the mechanism of FIG. 18A.

FIG. 18A is a side perspective diagrammatic view of a mechanism for attaching a sheet to a frame member in an embodiment of the invention. FIG. 18D is a side plan view of the mechanism of FIG. 18A. FIG. 18B is inset B of FIG. 18D. FIG. 18C is a second side perspective view of the attachment mechanism of FIG. 18A. The attachment mechanism comprises a wedge-shaped or other aperture 550, extending at least partially or fully through the length of a frame member 512, which may be any frame member used in embodiments of the invention. The aperture 550 may be of substantially any shape which has an opening to a sheet 516 that is narrower than the widest portion of the aperture, so that a wedge 552 or any other item extending at least partially through the length of the aperture 550 can be held in the aperture. Such a wedge 552 may be fixedly attached or pre-attached to one or more frame members 512, or allow for rapid detachment and reattachment to such a frame member by way of lateral movement through the aperture 550.

In embodiments of the invention, when a frame member 512 is attached to a second frame member (such as is depicted, for example, in FIGS. 14A-17B), lateral movement of the wedge 552 is inhibited at least to the extent that the wedge 562 remains in the aperture 550 of the frame member 512. The wedge 552 is attached, or is pre-attached in a fixed or removable relationship with a sheet 516. The combination of the sheet 516 with the wedge 552 is configured to fit within the aperture 550 such that the sheet may exit the aperture. The sheet 516 may be a rigid or flexible sheet and, as should be understood, a plurality of sheets may be used in one or more apertures and in one or more frame members. Similar to the embodiment of the invention using slots and frictional attachment, the sheet 516 need not be punctured or otherwise damaged.

Figure 19B:
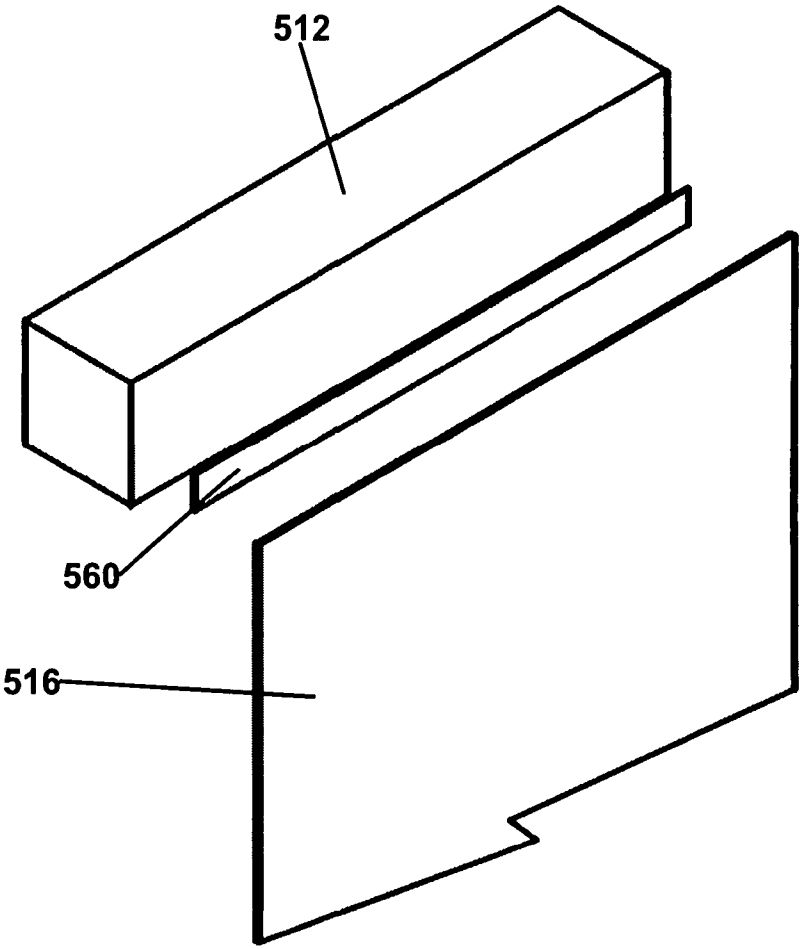
FIG. 19B shows a second blown-apart view of a tape attachment mechanism for attaching a sheet to a frame member in embodiments of the invention.
Figure 19A:
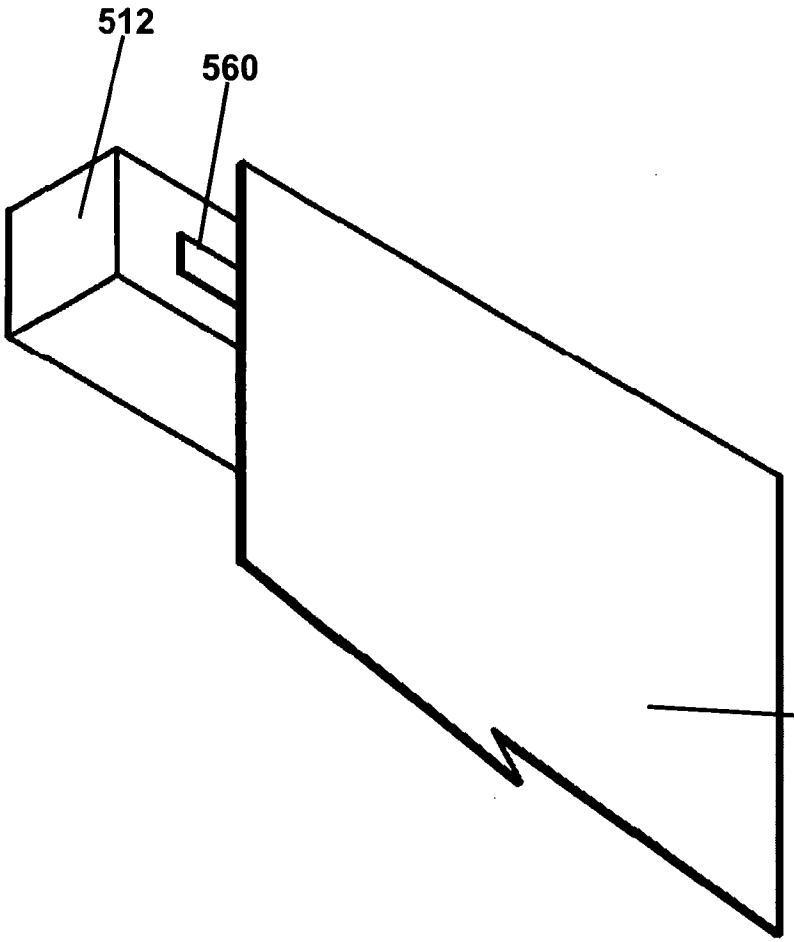
FIG. 19A shows a blown-apart view of a tape attachment mechanism for attaching a sheet to a frame member in embodiments of the invention.

FIGS. 19A and 19B show blown-apart views of a tape attachment mechanism for attaching a sheet to a frame member in embodiments of the invention. In an embodiment of this invention, the tape 560 may be double-sided tape attached on a first side to a frame member 512 and on a second side to a sheet 516. A frame member 512 may comprise a plurality of attachment mechanisms. Further, in an embodiment of the invention, the tape 560 may be magnetic tape. Magnetic tape allows for attachment and detachment of a sheet 516 to a frame member 512 without causing a change to the physical characteristics of a sheet or frame member. Double-sided or magnetic tape may also be used to attach corners of frame members to each other.

Figure 20C:
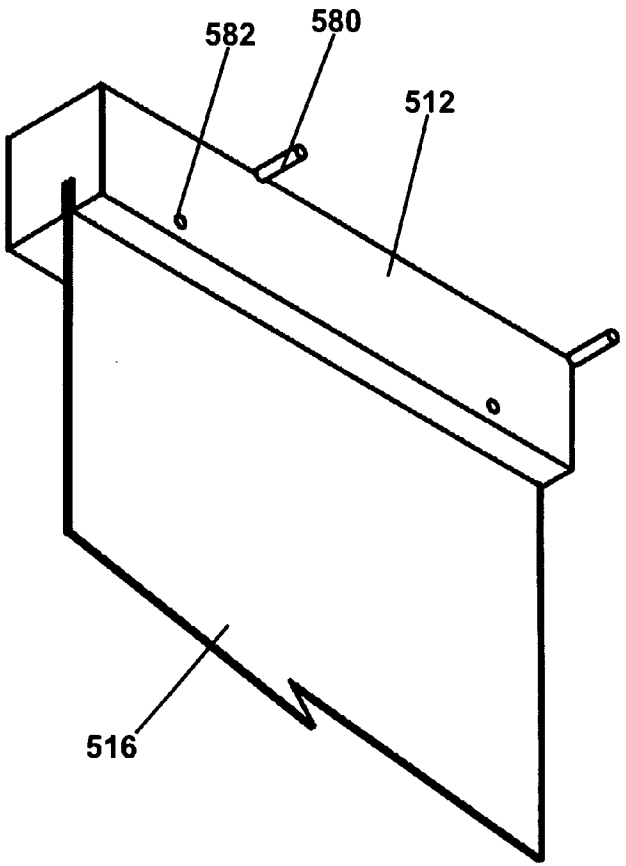
FIG. 20C is a side perspective view of another attachment mechanism.
Figure 20B:
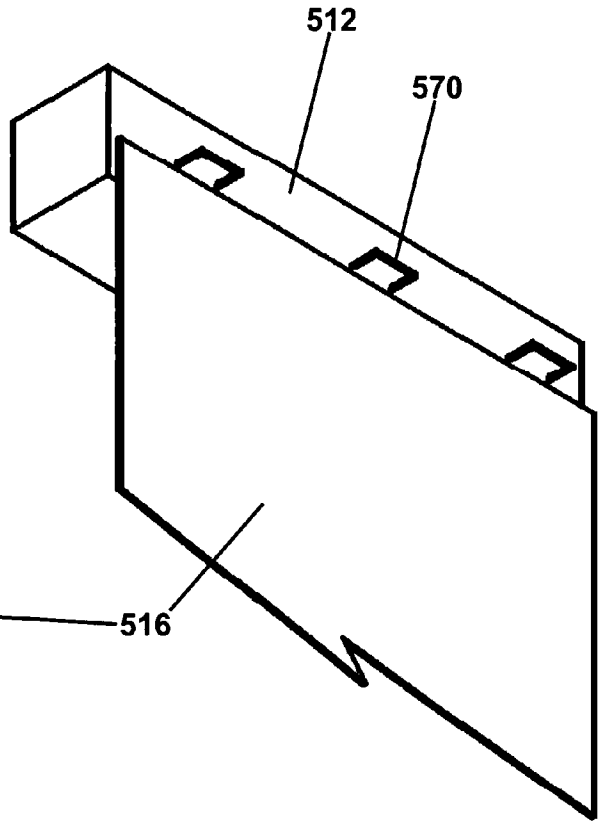
FIG. 20B is a side perspective view of FIG. 20A.
Figure 20A:
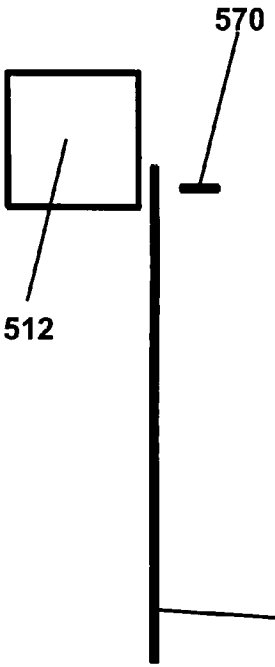
FIG. 20A shows a side plan view of a staple attachment mechanism for attaching a sheet to a frame member in an embodiment of the invention.

FIG. 20A shows a side plan view of a staple attachment mechanism for attaching a sheet to a frame member in an embodiment of the invention. FIG. 20B is a side perspective view of FIG. 20A. FIG. 20C is a side perspective view of another attachment mechanism. Staples 570, in the present embodiment, are used to puncture a hole through the frame member 512 and the sheet 516 to attach the respective pieces to each other. Such an attachment is substantially irreversible in that removal causes damage to either the frame member 512 or sheet 516. The attachment device of FIG. 20C may be a dowel 580 with pre-drilled aperture 582 which is substantially removable (does not cause damage when removed) or removable. The dowel 580, in embodiments of the invention, is a screw or nail. Such devices and attachment mechanisms may also be used to attach frame members to each other in a permanent or reversible manner.

Figure 21A:
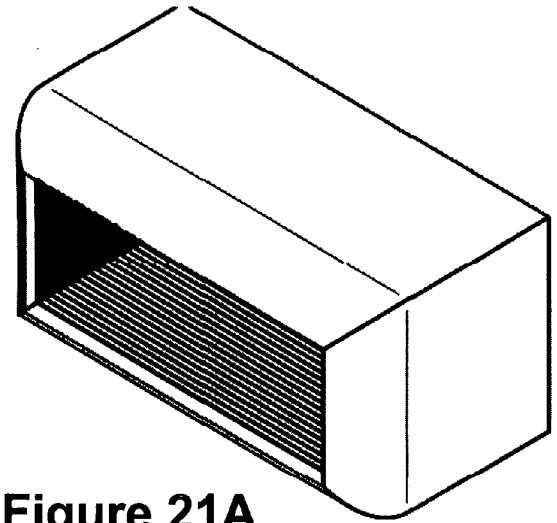
FIG. 21A shows a front perspective view of frame members of an embodiment of the invention used in conjunction with a plurality of sheets.
Figure 21B:
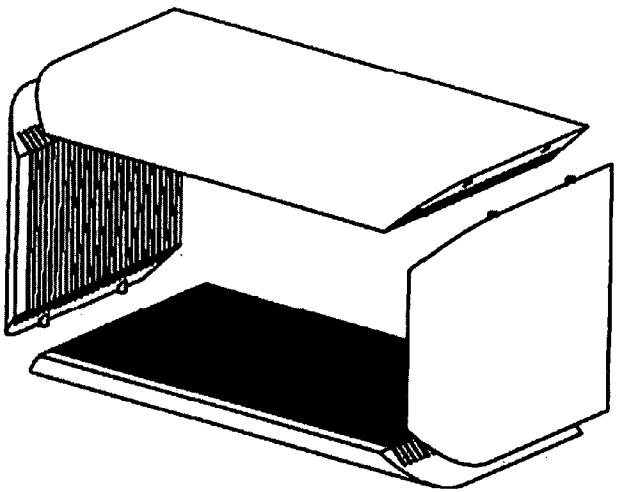
FIG. 21B shows a blown-apart version of FIG. 21A.
Figure 21C:
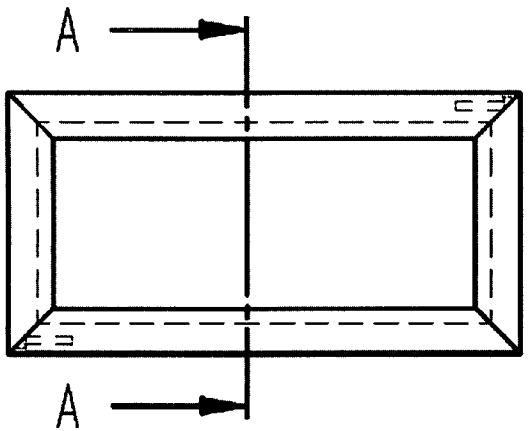
FIG. 21C shows a top plan view of a frame member of FIG. 21B.
Figure 21D:
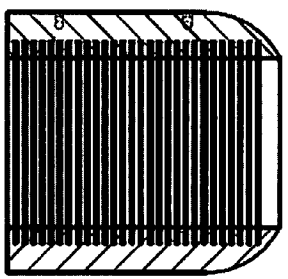
FIG. 21D shows a sectional view of the frame member of FIG. 21C cut along section line A-A.

FIG. 21A shows a front perspective view of frame members of an embodiment of the invention used in conjunction with a plurality of sheets. FIG. 21B shows a blown-apart version of FIG. 21A. FIG. 21C shows a top plan view of a frame member of FIG. 21B. FIG. 21D shows a sectional view of the frame member of FIG. 21C cut along section line A-A. In such an embodiment, many sheets may be used, such as 24 sheets. The sheets may be transparent, translucent or opaque and provide structural stability (rigid sheets) or may display a portion of an artistic work. The sheets may be pre-attached by any of the mechanisms described herein above or by other methods known in the art, or one or more sheets may be inserted into provided grooves and held between two attached frame members. A sheet may extend partially or fully across the length of a frame member, and the configuration of the sheets may be pre-selected for display of an artistic work in a specific configuration, for example.

In the method of the invention, the frame members may be placed in a tube and/or in a rolled configuration (see FIGS. 8-13). For purposes of embodiments of the method of the invention, each set of frame members and attached or corresponding sheet, as described with reference to embodiments of the device of the invention, is defined as a module. After unrolling and/or configuring one or more modules, the configuration comprising associating, attaching, or positioning sheets with respective frame members, a location may be selected in embodiments of the invention. The location may be, for example, a laboratory or other table or surface, an easel or stand, or a wall. A first module is either attached to or placed at the location by methods known in the art.

After positioning of the first module at a location, a second module is positioned on the first module. That is, the second module is aligned as desired by a user or manufacturer of the display at an angle offset from the first module. The angle of offset, when two modules are used, is 90 degrees. For example, when hanging a picture or information display or putting together a box for examination of biological or organic materials, the first module is placed and the second module is then placed on top of the first module in the reverse direction. If the first module is extending from a top to a bottom, the second module extends from the left to the right (or right to the left). It is contemplated and within the scope of the invention that the offset is between 15 and 90 degrees, inclusive. When the angle is less than 90 degrees, more than two modules are typically used.

At least one module is then attached to at least one other module, i.e. a first module to a second module, the attachment being an attachment of a frame member of a first module to a frame member of a second module. The frame members are typically attached at the corners thereof which are at the ends of the longitudinal members. They may be attached by any means known in the art or described with reference to the device of the invention.

Still further, an object may be placed between first and second sheets or first and second modules. The object may be a biological/organic object such as a culture for growth. The invention provides a method for placing the frame members of the modules in a preconfigured manner so as to minimize disturbance of a growth culture, gel electrophoresis, and the like. Still further, a frame member may comprises electrical components such as to provide a current for gel electrophoresis or a power source or data entry/exit portal to an electronic display, the electronic display being a sheet of a module or an object situated between two sheets. An combination of organic, artistic, organic, or other objects may be used with any combination of sheets.

While the invention has been taught with specific reference to the above embodiments, a person having ordinary skill in the art will recognize that changes can be made in form and detail without departing from the spirit and the scope of the invention. The described embodiments are to be considered in all respects only as illustrative and not restrictive. All changes that come within the meaning and range of equivalency of the claims are to be embraced within their scope.

I claim:

1. A frame comprising at least two pairs of elongate members, each elongate member having two ends, each pair of elongate members having at least one pre-attached sheet extending between said pair, and each end of each said elongate member adapted for fixed attachment with at least one end of another elongate member, wherein in an assembled condition, a display is formed with at least partially overlapping of said sheets and wherein a said sheet of a first pair of said elongate members substantially overlaps both a sheet of a second pair and a third pair of said elongate members.

2. A kit comprising at least two pairs of elongate members, each elongate member having two ends, each pair of elongate members having at least one pre-attached sheet extending between said pair, and each end of each said elongate member adapted for fixed attachment with at least one end of another elongate member, wherein in an assembled condition, a display is formed with at least partially overlapping of said sheets and wherein each pair of elongate members is preconfigured with a corresponding sheet and tube, wherein each pair of elongated members is removably inserted into said tube.

3. A frame comprising at least two pairs of elongate members, each elongate member having two ends, each pair of elongate members having at least one pre-attached sheet extending between said pair, and each end of each said elongate member adapted for fixed attachment with at least one end of another elongate member, wherein in an assembled condition, a display is formed with at least partially overlapping of said sheets and wherein at least one pair of elongate members comprises a plurality of sheets.

4. The frame of claim 3, wherein a first pair of said elongate members comprises a rigid backing sheet and a rigid cover sheet and a second pair of said elongate members comprises a flexible sheet.

5. A frame comprising at least two pairs of elongate members, each elongate member having two ends, each pair of elongate members having at least one pre-attached sheet extending between said pair, and each end of each said elongate member adapted for fixed attachment with at least one end of another elongate member, wherein in an assembled condition, a display is formed with at least partially overlapping of said sheets and wherein an attachment of an end of a first elongate member and an end of a second elongate member are selected from the group consisting of at least one magnet, adhesive, dowel and pin, mortise and tenon, magnetic tape, and a combination thereof.

6. A frame comprising at least two overlapping sheets, said sheets offset at least 15 degrees from each other, and each said sheet is attached at a first end to a first elongated frame member and a second end to a second elongated frame member, each said elongated frame member having two ends, and each said end of each said elongated frame member is being rigidly attached to an end of another elongated frame member, wherein each said sheet is frictionally held between two said elongated frame members in an assembled condition of said frame.

7. A frame comprising at least two overlapping sheets, said sheets offset at least 15 degrees from each other, and each said sheet is attached at a first end to a first elongated frame member and a second end to a second elongated frame member, each said elongated frame member having two ends, and each said end of each said elongated frame member is being rigidly attached to an end of another elongated frame member, wherein at least one said sheet is flexible.

8. A frame comprising at least two overlapping sheets, said sheets offset at least 15 degrees from each other, and each said sheet is attached at a first end to a first elongated frame member and a second end to a second elongated frame member, each said elongated frame member having two ends, and each said end of each said elongated frame member is being rigidly attached to an end of another elongated frame member, wherein said rigid attachment of said frame members is an attachment selected from the group consisting of at least one magnet, dowel and pin, mortise and tenon, magnetic tape, and a combination thereof.

9. A frame comprising at least two overlapping sheets, said sheets offset at least 15 degrees from each other, and each said sheet is attached at a first end to a first elongated frame member and a second end to a second elongated frame member, each said elongated frame member having two ends, and each said end of each said elongated frame member is being rigidly attached to an end of another elongated frame member, wherein said sheet is an electronic sheet.

10. The frame of claim 9, wherein said electronic sheet is flexible.

11. A method of configuring at least a first and second module of a display, each said module comprising two frame members and a sheet situated there between, said method comprising, in order, the steps of:

positioning a first module at a location;

positioning a second module on said first module, offset at least 15 degrees from said first module; and attaching at least one frame member of said first module to said at least one frame member of said second module;

wherein said location is a table.

12. The method of claim 11, further comprising the step of placing an object between said first and second module before said step of attaching.

13. The method of claim 12, wherein said object is selected from the group consisting of organic, artistic, and electronic objects.

14. The method of claim 12 further comprising a step of removing at least one said module from a tube.

* * * * *